United States Patent [19]

Weimann

[11] Patent Number: 4,982,667

[45] Date of Patent: Jan. 8, 1991

[54] ARRANGEMENT FOR PRODUCTION OF EXPLOSIVELY FORMED PROJECTILES

[75] Inventor: Klaus Weimann, Rümmingen, Fed. Rep. of Germany

[73] Assignee: Franhofer-Gesellschaft zur Forderung der angewandten Forschung e.V., Munich, Fed. Rep. of Germany

[21] Appl. No.: 268,453

[22] Filed: Oct. 28, 1988

Related U.S. Application Data

[63] Continuation of Ser. No. 742,072, Aug. 20, 1984, abandoned.

[30] Foreign Application Priority Data

Aug. 19, 1983 [DE] Fed. Rep. of Germany ..... 3329969

[51] Int. Cl.[5] ..... F42B 1/02

[52] U.S. Cl. ..... 102/476; 102/306; 102/701

[58] Field of Search ..... 102/305–310, 102/475, 476, 501, 701

[56] References Cited

U.S. PATENT DOCUMENTS

| | | | |
|---|---|---|---|
| 3,146,711 | 9/1964 | Schaadt et al. | 102/476 |
| 3,217,650 | 11/1965 | Paul | 102/476 |
| 3,732,818 | 5/1973 | Thomanek | 102/306 |
| 4,374,495 | 2/1983 | Thomanek | 102/306 |
| 4,510,870 | 4/1985 | Walters | 102/307 |
| 4,513,666 | 4/1985 | Segletes | 102/307 |
| 4,590,861 | 5/1986 | Bugiel | 102/501 |

FOREIGN PATENT DOCUMENTS

| | | | |
|---|---|---|---|
| 1209463 | 1/1966 | Fed. Rep. of Germany | 102/476 |

*Primary Examiner*—David H. Brown

*Attorney, Agent, or Firm*—Antonelli, Terry, Stout & Kraus

[57] ABSTRACT

An arrangement for production of explosively formed projectiles consists of a casing with explosive contents, a fuse arranged on the base side and a metal insert which covers the explosive contents on the head side, in which case the projectile acquires wing-like symmetrical folds on its tail by means of the following. The insert and/or the explosive contents and/or the fuse in their outside area and/or the casing on its jacket features at least three inhomogeneities arranged at a distance from the axis of the casing in a symmetrical manner around the circumference such that in the circumferential area of the insert varied. Acceleration is achieved according to the configuration of the inhomogeneities or the impact time of the shock wave or its impact energy is different.

8 Claims, 3 Drawing Sheets

ARRANGEMENT FOR PRODUCTION OF EXPLOSIVELY FORMED PROJECTILES

This application is a continuation of application Ser. No. 742,072, filed Aug. 20, 1984, now abandoned.

BACKGROUND OF THE INVENTION

The invention relates to an arrangement for production of explosively formed projectiles including a casing with explosive contents, a fuse located on the base side and a metal insert covering the explosive contents on the head side.

Devices of this type are also called hollow charges in a very simple version. A hollow charge consists of the aforementioned parts in which case the casing is a round cylinder. The effect of a hollow charge of this type consists of the following. When the explosive is ignited the insert is broken down into individual particles which then fly toward the target in the manner of a projectile. All efforts with these hollow charges are directed at obtaining material particles which strike the target with maximum possible energy. In practice this is achieved as follows (for example DE-AS No. 19 10 779). By means of appropriate shaping of the insert it is broken down to several small particles, the so-called "jet" and into one or more large particles, the so-called "ram". This insert, for example, is shaped in the manner of a round roof. A smaller number of larger oblong particles should also be produced by virtue of the fact that the round roof shaped disk features a concentric predetermined breaking point.

The desire to build oblong projectiles of large mass which incorporate on the one hand favorable flight properties, on the other hand correspondingly high impact energy, has led to consideration of forming the insert from a composite material, consisting, for example, in its center of a relatively heavy material, steel over most of its area and aluminum in the edge region. With the appropriate layout of the explosive contents this insert can be formed into a single longitudinal projectile similar to a bullet, e.g., it features a rounded nose, and a following cylindrical or slightly conical oblong section. The tail of this projectile is disk shaped. This projectile flies in a satisfactory manner to the target, however does not exhibit great impact energy since the air resistance is unfavorable due to the disk-like tail and thus the projectile loses a considerable amount of velocity in flight.

The aim underlying the invention resides in providing an arrangement of the aforementioned type such that explosive projectiles are produced with faultless and reproducible flight properties and which strike the target in an optimum configuration with small loss of velocity.

This is achieved as follows. The insert and/or the explosive contents and/or the fuse in their external region and/or the casing on a jacket thereof include at least three inhomogeneities arranged on a circle at a distance from the axis of the casing such that, in the circumferential region of the insert, varied acceleration is achieved corresponding to the configuration of the inhomogeneities or the time of impact of the shock wave or impact energy is different.

The invention proceeds initially from the fact that a projectile obtained by explosive forming exhibits faultless flight properties only if efforts are made to achieve those preferred directions for the deformation process on the insert which lead to forming at different times so that it is permanently ensured that adjacent areas of the insert are not formed simultaneously, but rather in succession or with different accelerations. If this rule is followed it can be assumed that in the course of the forming process unobserved accumulations, upsetting or overlapping of the material do not occur which would lead to fraying of the tail. Based on this finding the general principle of the invention consists in the following. The parts which comprise the device each exhibit inhomogeneities for themselves or in combination at specific sites near the circumference which result in the fact that the shock wave produced by the explosive contents does not react on the varied mass coating on the insert either at the same time or with the same impact energy on the entire insert, but at specific and symmetrically arranged points in the area of the insert near the circumference at different times or with different impact energy. This achieves the following. The areas where the shock wave arrives earlier or with greater impact energy are deformed first and the other areas afterward. If the inhomogeneity consists in a varied mass coating, the areas of lower mass are shaped with greater acceleration than the areas lying in between. This principle can be realized by the corresponding symmetrically arranged inhomogeneities on the insert itself, on the explosive contents, the fuse or ultimately even on the casing. Inhomogeneities on the insert lead primarily to different forming rates of the same. Inhomogeneities of the explosive contents lead to different impact energies on the insert. The same applies to inhomogeneities on the fuse which however also lead to different impact times. Finally inhomogeneities in the casing lead to varied damming upon detonation and thus to different impact energies on the insert.

Preferably, according to the present invention the insert features essentially radially deformations arranged in the circumferential region as inhomogeneities which can be formed, for example, as wave profiles of small height. In this case profiles preferably in the tenth of a millimeter range are involved. Instead or in addition the deformations can be formed by increasing the density of the material.

In another design which may also be intended for deformations if necessary, the insert features essentially radially points with different wall thickness arranged in a circumferential area. These wall thickness differences extend preferably into the tenth of a millimeter range. In these cases approximately radial inhomogeneities are provided in the insert which results in the fact that the insert deforms in a specific and symmetrical manner upon impact of the shock wave. Practical studies have shown that projectiles can be obtained in this way which feature rounded nose, a longer, approximately cylindrical section and a uniform longitudinal fold on the tail in which case the number of folds corresponds exactly to the number of inhomogeneities present. The depth and shape of the folds can be influenced within wide limits by lengthening of the inhomogeneities. These folds act as stabilizing rings in flight. Practical tests have demonstrated outstanding flight properties in that the projectile is aligned with its longitudinal axis in the flight path and also maintains this position. A slight inclination when the projectile leaves (which cannot be avoided) is stabilized after some oscillating motions with a slight deflection so that almost any projectile strikes the target in the desired flight attitude. Forming of wings is also responsible for considerably less loss of speed so that a corresponding high impact energy is available.

An equally beneficial effect can be achieved as per another version as follows. Explosive contents feature varied explosive coating arranged symmetrically in the circumferential area as inhomogeneities. Here this symmetrically varied coating can be achieved by explosives of different types or the same explosive in different concentrations. This leads to different impact times and/or impact energies on the insert so that the insert is first shaped in the preferred directions and afterwards in another region.

The same effect can be achieved in another version as follows. The explosive contents feature symmetrical guides arranged symmetrically in the casing as inhomogeneities which deflect the shock wave in a correspondingly symmetrical form to specific areas of the insert and/or also dam the shock wave at correspondingly symmetrical points.

In another version the fuse exhibits ignition points arranged symmetrically in the circumferential area with lower ignition energy and/or delayed ignition timing. This again leads to the fact that the shock wave reaches the corresponding symmetrically arranged points on the insert according to the arrangement of the ignition points or their time delay at different times.

Finally, according to another version, the casing can exhibit wall thickness which varies in a symmetrical configuration as inhomogeneities. This varying wall thickness leads to varied lateral damming of the explosive and thus to different departure velocity of the coating. The coating is slower at points of lower wall thickness than at the more heavily dammed points on the casing. Since this varied damming is effective primarily in the circumferential area, this measure tells only in the circumferential area of the insert, as designed.

A version of this principle of especially simple production technology consists in forming the casing as a round cylinder on the inside and a multiple sided figure on the outside.

The principle of the invention can be further developed by the following. The inhomogeneities protrude to varying degrees, however, at least two inhomogeneities of the same degree of protrusion are present and are symmetrically arranged.

This additional principle of the invention leads to the fact that the folds which form on the tail of the projectile are of varied depth, therefore they form wings of varied width. The symmetrical configuration of at least two such inhomogeneities of different amounts of projection however guarantees that again a structure of wings symmetrical to the projectile axis is obtained.

Finally, according to another feature of the invention, the inhomogeneities can be formed asymmetrically, in which case however they exhibit completely identical asymmetry. This design leads to the fact that within each inhomogeneity preferred directions are fixed with the result that deformation of the insert in the area of each inhomogeneity does not take place absolutely simultaneously, but at slightly different times or with slightly different impact energy or ultimately with different acceleration. On the explosively formed projectile this is manifested by the fact that the folds on the tail are not formed parallel to the axis of the projectile, but acquire a slope. Sloped wings in which capacity the folds act here, can impart to the projectile a stabilizing angular momentum.

DETAILED DESCRIPTION

Figure 1:
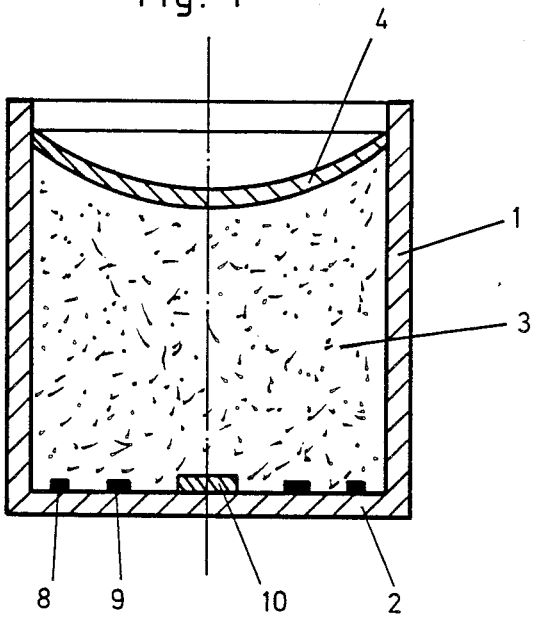
FIG. 1 is a schematic longitudinal section through the arrangement.

The arrangement shown in FIG. 1 consists of a casing 1 with a base 2 which is filled with explosive 3 and sealed on the head side with insert 4. In the area of base 2 is a fuse 10. Casing 1 is cylindrical, insert 4 is formed as a cambered disk of small wall thickness. It consists of a metal, for example steel, copper or heavy metal.

Figure 2:
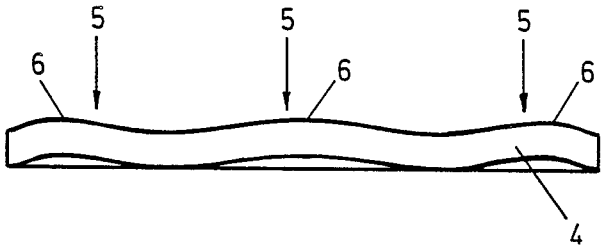
FIG. 2 is a side view of one version of the insert.
Figure 3:
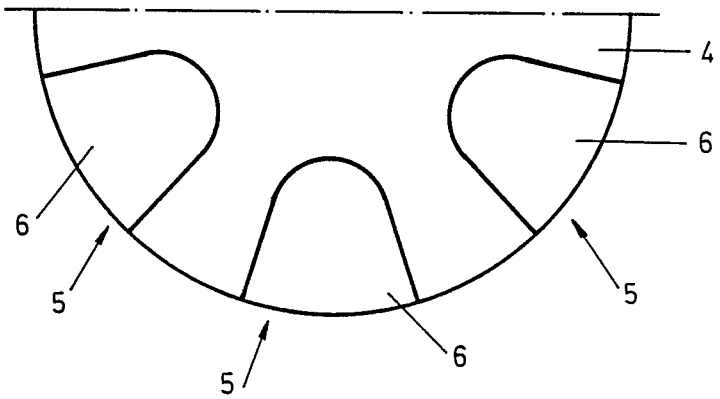
FIG. 3 is an overhead view of the insert according to FIG. 2.

In the version according to FIG. 2 insert 4 exhibits inhomogeneities which appear as wavy deformation 6 of the disk. These deformations extend, as FIG. 3 indicates, essentially in the radial direction and join with a certain radial distance from the center of the disk to stop on the external circumference of the disk. These waves exhibit a height which increases from inside to the outside. The inhomogeneity can be even more greatly pronounced by virtue of the fact that for example the wall thickness in the area of the "wave crest" is reduced; this occurs simply by overgrinding disk 4 on its side facing the wave crest so that a section occurs, approximately as shown in FIG. 3.

Figure 6:
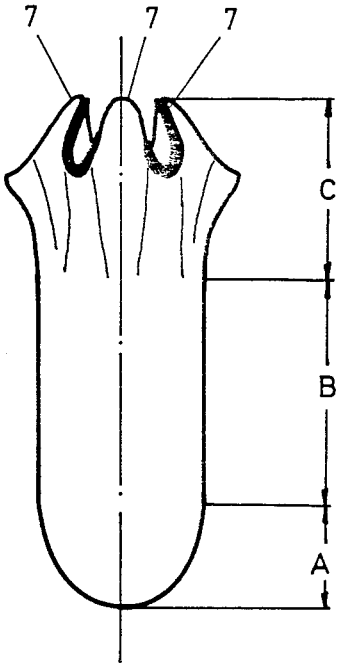
FIG. 6 is a version of an explosively formed projectile in a side view.
Figure 7:
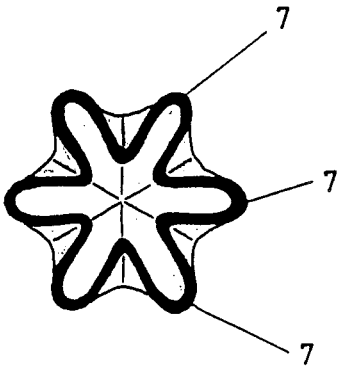
FIG. 7 is a view of the tail of the projectile according to FIG. 6.

When the explosive contents 3 are detonated, a curved shock wave is formed which first impacts on the center of disk 4 so that there deformation begins. All other outside areas are struck by the shock wave with slight time delay so that initially the disk is bent in the center. By means of the inhomogeneities 5 the shock wave then impacts on the areas between the wave crests 6 in the circumferential area of the disk so that there deformation begins first while areas 6 are struck later and lag behind in the deformation process. This ultimately leads to a projectile as shown in FIGS. 6 and 7. It consists of a Section A which is formed from the central area of disk 4 and which imparts a rounded nose to the projectile, and of Section B of largely cylindrical oblong shape. Sections A and B are massive. In Section C individual regularly arranged folds 7 can be recognized which act as stabilizing rings for the projectile. Their symmetrical configuration and intrinsically symmetrical formation can be seen on the overhead view of the projectile tail according to FIG. 7.

Instead of inhomogeneities 5 in insert 4 or in addition to the latter inhomogeneities can also be provided on the fuze 10 in that either several ignition points 8, 9 of varied ignition energy or different ignition delay are arranged in an approximately symmetrically manner on the base side end of casing 1.

Figure 4:
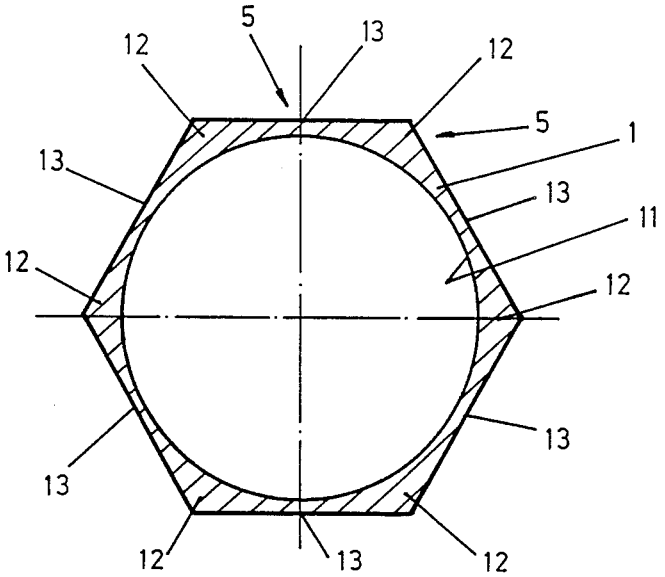
FIG. 4 is a cross-section through the casing in an initial version.

Another design which is simple primarily in terms of production technology is shown in FIG. 4. Here the casing is formed internally as cylinder 11, while externally it represents a multiple sided figure, a regular hexagon in the version shown.

In regions 12 this leads to a greater wall thickness, in regions 13 to a minimum wall thickness. Based on this varying wall thickness damming is greatest in regions 12, least in regions 13. Accordingly in the projection of region 12 more energy is transferred to insert 4 and the latter accelerated more strongly there, while the insert in the projection of regions 13 lags behind in the shaping process.

Figure 5:
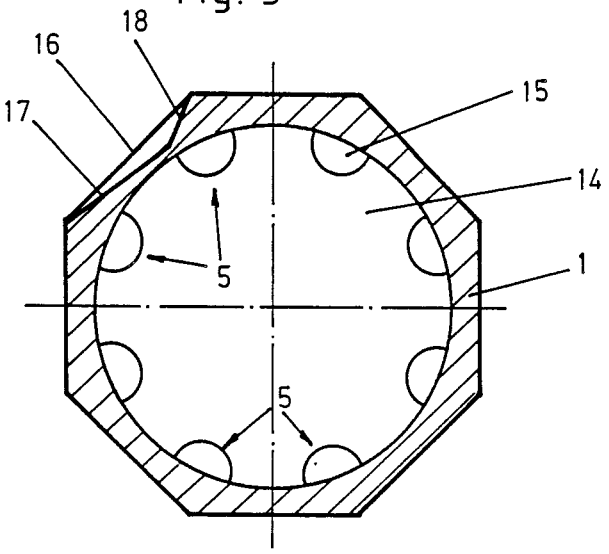
FIG. 5 is a cross-section through the arrangement representing two other versions.

FIG. 5 shows a symmetrically varied explosive coating in combination with the version according to FIG. 4 (here on an octagon). While most of casing 1 is filled with explosive 14 of a certain energy, in the area of the corners of the multiple sided figure another explosive 15 is located which exhibits for example higher energy or energy density and thus supports the effect of the greater damming there. Of course a different fuel coating in a symmetrical configuration can also be provided with a completely symmetrical casing 1.

Finally FIG. 5 shows a version in which the inhomogeneities are formed intrinsically asymmetrically, only one asymmetrical inhomogeneity being illustrated. Thus, on the outside surface 16 of casing 1 it is apparent that it can also be asymmetrically pulled to the inside by asymmetrically dispos sloped surfaces 17, 18. This asymmetry which is otherwise uniform with all inhomogeneities imparts a slope vis-a-vis the axis of the projectile to folds 7 (FIGS. 6 and 7) of the projectile so that the projectile acquires angular momentum in flight.

I claim:

1. A device for producing an explosive formed projectile including a casing filled with an explosive charge, ignition means on a base side of said casing, and a metal insert covering the explosive charge on a head side of said casing, the device including at least three means arranged along a circle and at a distance from a longitudinal axis of the casing for causing a circumferential area of the casing to be subjected to different accelerations when a shock wave of the ignited charge reaches the insert, characterized in that said means for causing are provided in at least one of the insert, the explosive charge, and the ignition means on a circumferential circle in at least one of an external area thereof, and the casing on an external surface thereof so that one of the impact point of time and the impact energy of the shock wave differ in a circumferential area of the casing.

2. A device according to claim 1, characterized in that said means for causing includes a varying of explosive concentration of the explosive charge arranged symmetrically in circumferential area of the explosive charge.

3. A device according to claim 1, characterized in that the ignition means comprises at least one of ignition points of lower ignition energy and delayed ignition time arranged symmetrically in the circumferential area.

4. A device according to claim 1, characterized in that said means for causing comprises a casing wall thickness varying in a symmetrical configuration.

5. A device according to claim 1, characterized in that the casing comprises a cylindrical inner side and a multiple sided outer side.

6. A device according to claim 1, characterized in that at least one of the means for causing is asymmetrically disposed.

7. A device according to claim 1, characterized in that the insert is substantially disk shaped, and wherein said means for causing includes substantially radially extending deformations provided in a circumferential area of the insert.

8. A device according to claim 7, characterized in that the deformations include a wave profile having a relatively low wave height.

* * * * *